United States Patent [19]

Haynes et al.

[11] Patent Number: 4,648,292

[45] Date of Patent: Mar. 10, 1987

[54] TONG ASSEMBLY

[75] Inventors: Charles W. Haynes, Marshall; Frank W. Gault, Houston, both of Tex.

[73] Assignee: Joy Manufacturing Company, Pittsburgh, Pa.

[21] Appl. No.: 818,062

[22] Filed: Jan. 13, 1986

Related U.S. Application Data

[63] Continuation of Ser. No. 591,077, Mar. 19, 1984, abandoned.

[51] Int. Cl.[4] ..... B25B 28/00

[52] U.S. Cl. ..... 81/57.16; 81/57.34

[58] Field of Search ..... 81/57.16, 57.2, 57.34

[56] References Cited

U.S. PATENT DOCUMENTS

| | | | |
|---|---|---|---|
| 4,005,621 | 2/1977 | Turner et al. | 81/57.2 |
| 4,200,010 | 4/1980 | Hewitt | 81/57.34 X |
| 4,437,363 | 3/1984 | Haynes | 81/57.18 |
| 4,494,425 | 1/1985 | Shewmake | 81/572 X |

*Primary Examiner*—Frederick K. Schmidt
*Assistant Examiner*—Debra S. Meislin
*Attorney, Agent, or Firm*—Edward L. Levine

[57] ABSTRACT

A tong assembly for makeup and break out of tool joints including a power tong and a backup tong which is rotatable through a limited rotation with respect to the power tong. During a torquing operation a single, self energizing free jaw and die grips the lower tubing of the tool joint in cooperation with two surfaces of a hardsurfaced bushing. The tool joint is gripped eccentric to the longitudinal centerline of the backup tong, and aligned with the longitudinal centerline of the power tong.

13 Claims, 11 Drawing Figures

TONG ASSEMBLY

This application is a continuation of application Ser. No. 591,077, filed Mar. 19, 1984, now abandoned.

FIELD OF THE INVENTION

This invention relates to power tongs of the type used to make up and break out tool joints in oil field drilling applications, and more particularly provides an interconnected power tong and backup tong assembly.

BACKGROUND OF THE INVENTION

Numerous tong assemblies exist which are effective to make up and break out a threaded tool joint. However, many of these tongs are complex in design and operation and/or limited with respect to the size range of drill pipe which can be accommodated. Some tongs grip a tool joint at only two locations, increasing the potential for slipping of the joint from the grip of the jaw dies, and for wear of the dies, as well as the potential for overstressing of the tool joint. Other tongs alleviate these limitations through the use of three or more movable jaws and associated gripping dies. Exemplary of this type of tong is that described in U.S. Pat. No. 4,005,621, assigned to the assignee of the instant invention, which teaches the simultaneous camming engagement of preferably three jaw dies with a tool joint whereby equal forces are applied to the joint. The patent also teaches a backup tong suspended from a power tong, the backup tong requiring inversion for the respective makeup or break down operation. The power tong and backup tong described in the patent, as with all known tongs, is designed such that during operation the tool joint is positioned with its central axis along the longitudinal axis of the tongs. The tool joint is centered in the primary openings surrounding the tool joint during operation.

It is desirable to provide a tong assembly, including an interconnected power tong and backup tong, wherein the backup tong effectively contacts a tool joint at at least three points, and which allows makeup and break out without inverting the backup tong.

SUMMARY OF THE INVENTION

This invention provides a tong assembly which allows three point contact of a backup tong with the tool joint through single point contact of a jaw. The tong assembly is relatively simple in construction and operation, and operates without inversion of the backup tong. And, during operation the longitudinal centerline of the backup tool is displaced from the central axis of the tool joint.

In preferred form a power tong of conventional design, for example as disclosed in the above-discussed U.S. patent, is interconnected with a backup tong, the power and backup tong each having a forward opening for receiving a tool joint. The backup tong is positioned beneath the power tong, and is generally parallel thereto, so that both are in a horizontal plane during operation on vertically extending pipe and tubing joints. Terms used throughout this disclosure such as "upper" or "lower" refer to the position of a component with the tongs in the horizontal plane. A pair of elongated support arms extend from the rearward portion of the power tong to the forward portion of the backup tong. The arms are preferably kinked and sufficiently flexible to allow limited lateral displacement and rotation of the backup tong in a horizontal plane relative to the power tong. The power and backup tongs are also affixed at their rearward portions through a pin-and-slot connection allowing relative forward and rearward motion between the power and backup tongs. An extension at the rear of the backup tong has a square cross section which is loosely contained within a square opening of a gusset fixedly attached to the power tong to further allow displacement and particularly limited rotation.

The backup tong receives the tool joint to be gripped within a channel shaped replaceable bushing having two parallel side surfaces at right angles to a rear surface. The dimension across the side surfaces of the bushing is larger than the outside diameter of any tool joint which will be gripped. The bushing also includes a window between its upper and lower surfaces which allows entry into the interior of the channel by a free camming jaw with a die having gripping teeth. The far end of the jaw is also formed as a gear intermeshing with a power gear driven by a hydraulic piston in a cylinder pivotally pinned to the backup tong. These power train components are supported between an upper and lower plate assembly.

Two power trains, each including a free jaw, are mounted to the backup tong, one being used during makeup of the joint and the other being used during break down. The jaws are each configured as a cam and, as described more fully hereinafter, are self energizing to seat firmly in position against the bottom pipe of a tool joint during a gripping operation.

Affixed to the rear of the backup tong is a pivotable stiff arm, extendable and retractable during motion of the backup tong onto and off of the tool joint, and during limited rotation of the backup tong relative to the power tong. The stiff arm is connected to the rear of the backup tong through a dual pin, universal type hinge. The stiff arm is pivoted by a hydraulic cylinder and includes a connection allowing free extension and retraction through a telescoping connection between two cylindrical tubes.

It has been discovered that operation of prior tongs is dependent upon the degree to which the longitudinal centerlines of the power tong and backup tong are maintained coincident with the central axis of the tool joint, and also each other. More coincident positioning of these axes is desirable as it results in smoother operation of the tong assembly.

In operation of the tong assembly disclosed herein, the forward openings of the power tong and backup tong are slipped about the tool joint such that the upper pipe can be gripped by the power tong and the lower pipe can be gripped by the backup tong. The tool joint is then gripped by the jaws of the power tong in conventional manner, the central axis of the tubes being positioned along the longitudinal axis of the tong. However, in contradistinction to the prior art, the backup tong is moved into position whereby the central axis of the pipes is displaced laterally from the longitudinal centerline of the backup tong. The tool joint is positioned in the corner of the bushing such that the joint is contacted by the rear surface and one side surface at approximately 90°, and a third firm point of contact is subsequently established by the die teeth of the camming free jaw. The lateral deflection of the support arms allow the backup tong to be displaced off center with respect to the power tong.

To, for example, make up a threaded connection, the upper pipe is rotated by the power tong and the lower pipe is retained in place by the three point contact of the backup tong. As the torque from the power tong increases, the lower pipe has a tendency to slip minimally in the bushing. However, the gripping force of the camming free jaw increases upon the minimal slippage, until a point at which the camming free jaw, and lower pipe, are fixed in position by this so termed self-energizing action. At this point continued application of torque to the joint is resisted in the backup tong housing by forces flowing between the camming free jaw and the bushing. The reactive force at the pivotal connection tends to rotate the entire backup tong about the point of contact of the camming jaw and the lower pipe. This relative rotation between the power tong and backup tong is accommodated by the support arms.

Breakout of a joint is substantially similar to the makeup operation, except that the tool joint is supported on the opposite corner of the bushing and a second camming jaw, extending into the bushing from the opposite side of the tong, is utilized to contact and grip the lower pipe.

BRIEF DESCRIPTION OF THE DRAWINGS

The advantages, nature and additional features of the invention will become more apparent from the following description, taken in connection with the accompanying drawings, in which.

DESCRIPTION OF THE PREFERRED EMBODIMENTS

Figure 1:
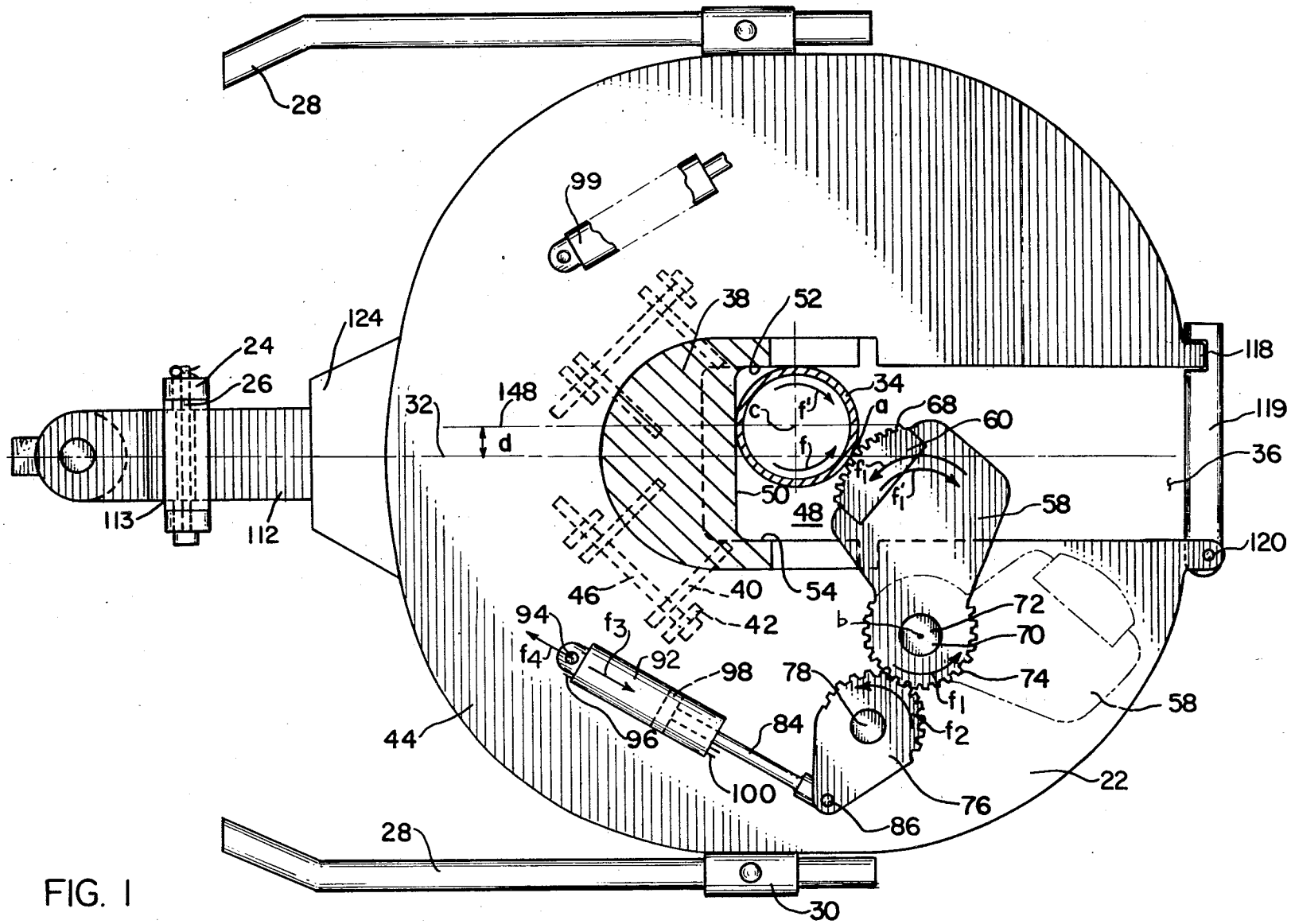
FIG. 1 is a simplified top view of selected components of a backup tong in accordance with the invention.
Figure 2:
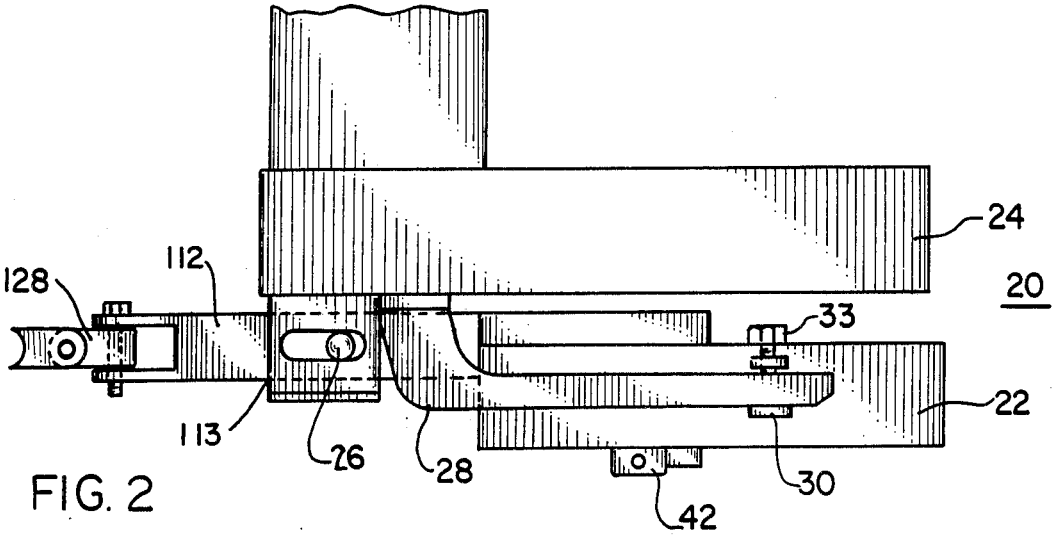
FIG. 2 is a simplified side view of the backup tong of FIG. 1.

Referring now to FIGS. 1 and 2 there is shown a tong assembly 20 including a backup tong 22 mounted beneath a power tong 24. The interconnection between the power and backup tongs allows limited relative movement between the power and backup tongs. More specifically, a pinned connection 26 allows forward and rearward sliding of the backup and power tongs relative to one another. At the region of the pinned connection, as shown best in FIG. 2, an extension 112 of the backup tong having a square channel cross section is supported within a larger square opening 113. The squares are arranged with parallel sides and this interconnection allows a limited rotation of several degrees between the power and backup tongs in a plane perpendicular to the central axis of the tool joint. A pair of support arms 28 are affixed to the rearward portion of the power tong 24, such as by mechanical fasteners or integral welding, and extend downwardly and forwardly for connection with clips 30 toward the forward end of the backup tong 22. The clips 30 include means for leveling the backup tong 22 relative to the power tong 24, such as a screw adjuster 33. The support arms 28 are sufficiently flexible to allow lateral offset, particularly at the forward portion, between the power tong 24 and backup tong 22, as well as a limited rotation of the backup tong 22 relative to the power tong 24 in a horizontal plane.

As used throughout this disclosure and the appended claims, "lateral" refers to a direction normal to a longitudinal axis of the power or backup tong, the longitudinal axis of the backup tong being identified in FIG. 1 by the reference numeral 32 applied to the longitudinal centerline of the backup tong. "Forward" refers to the end of the power or backup tong which has an opening to receive a work piece such as a pipe, tubular member or tool joint 34. The axis of the tubular workpiece is referred to as a central axis (c) and is described as being vertically positioned.

Figure 3:
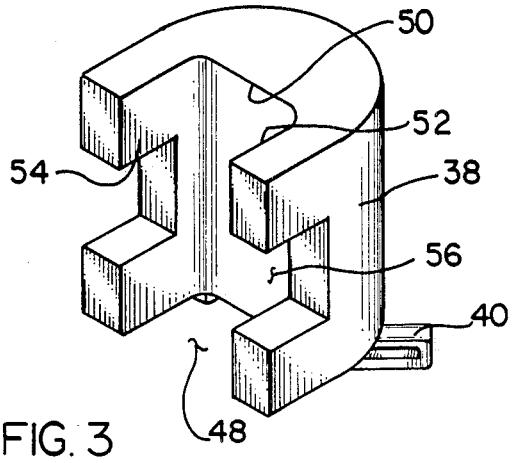
FIG. 3 is a perspective view of a replaceable bushing in accordance with the invention.

The backup tong 22 has an opening 36 which can be moved into a position about the tool joint 34. Positioned within the opening 36 is a replaceable positioning bushing 38. Affixed to the bushing 38 are attachment lugs 40 (FIGS. 1 and 3) which are mounted to mating lugs 42 (FIGS. 1 and 8) on a housing 44 of the backup tong 22 by an attachment bolt 46. The bushing 38 forms a channel shaped interior area 48. The interior of the bushing is formed between a flat rear surface 50 and two flat side surfaces 52, 54. The side surfaces are generally parallel to each other and normal to the rear surface. The side and rear surfaces are hardsurfaced to allow the tool joint 34 to rotate slightly under extreme forces without galling of the joint 34 or the bushing 38. A window 56 is formed in the bushing 38 to allow passage of a free jaw 58 and die 60 subassembly into and out of the interior area 48.

Figure 4:
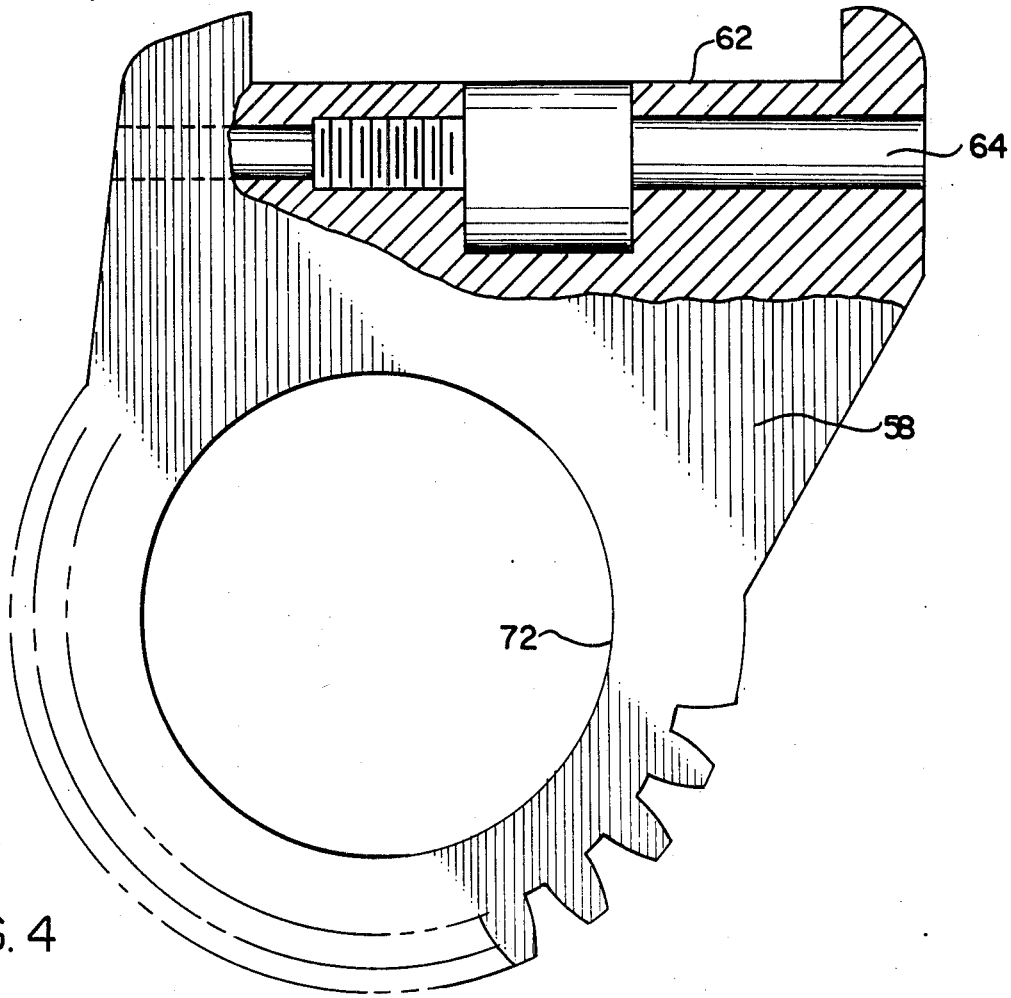
FIG. 4 is a top view, partially in section, of a free jaw.
Figure 5:
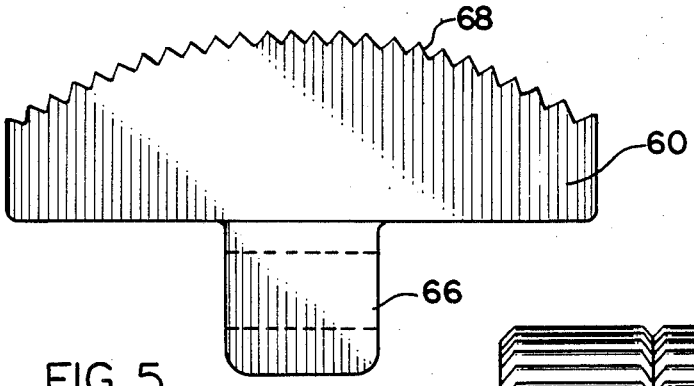
FIGS. 5 and 6 are respectively a side and front view of a die positionable on the free jaw of FIG. 6.
Figure 6:
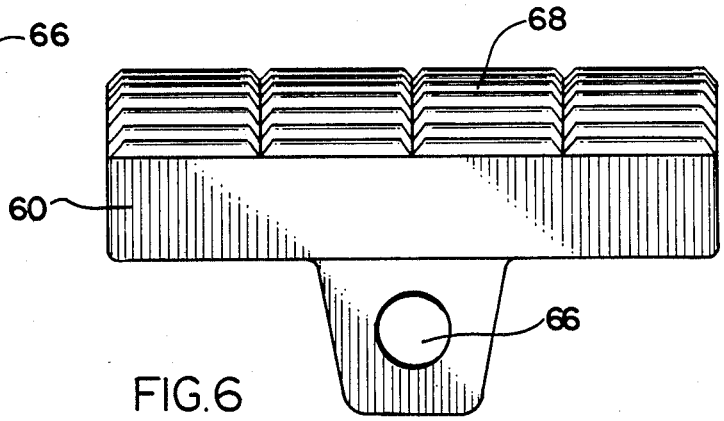

The replaceable die 60 (FIGS. 1, 5 and 6) is seated within a cutout 62 of the free jaw 58 (FIGS. 1 and 4) and is held in position by a bolt (not shown) aligned through a passage 64 in the jaw 58 and a slot 66 in the die 60. The die 60 has teeth 68 which contact and engage the lower pipe of the tool joint 34. The free jaw 58 pivots about a pin 70 which passes through an opening 72 in the free jaw. The jaw also includes gear teeth 74 which intermesh with a power gear 76.

Figure 7:
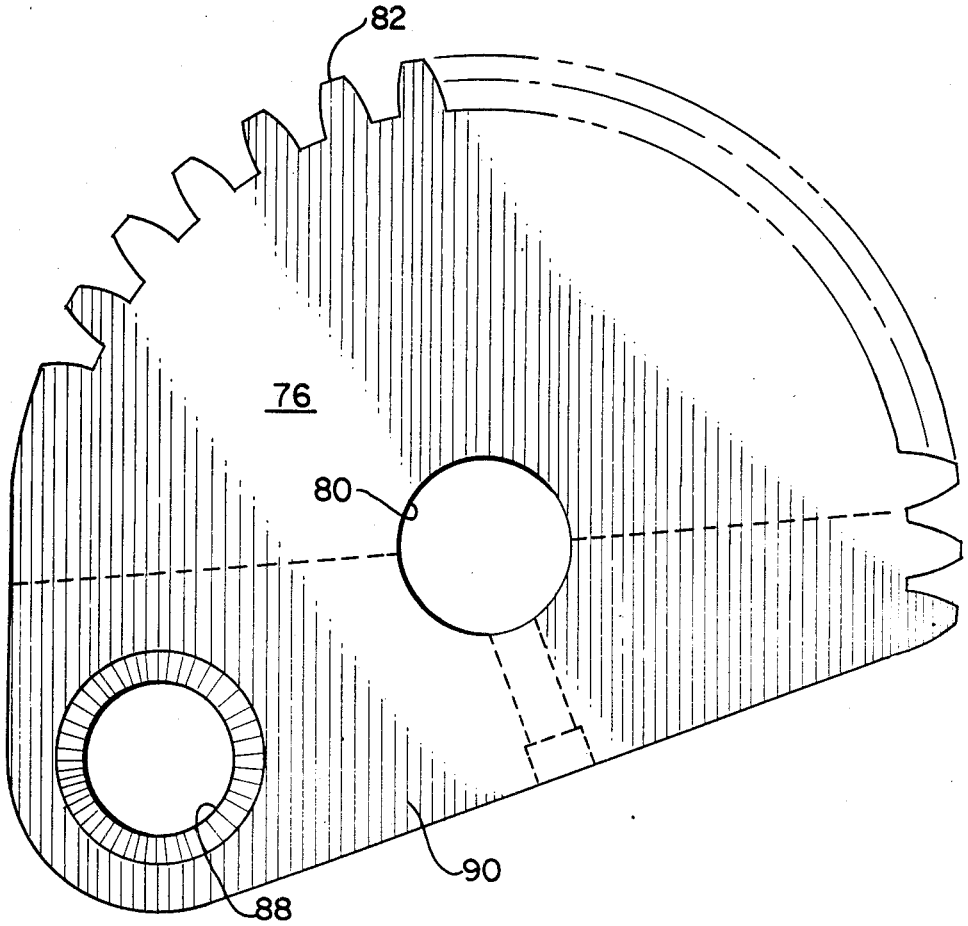
FIG. 7 is a plan view of a power gear.

The power gear 76 (FIGS. 1 and 7) pivots about a pin 78 passing through an opening 80. The power gear has teeth 82 which mesh with the teeth 74 of the free jaw. An end of the power gear opposite the gear teeth 82 is pivotally affixed to a piston rod 84 through a pin 86 passing through openings 88 in two ears 90 of the gear 76.

The piston rod 84 extends from a cylinder 92. The cylinder 92 is pivotally pinned for rotation about a pin 94 affixed to the housing 44. The cylinder 92 includes a port 96 for inletting and outletting a driving fluid, preferably hydraulic, into the cylinder behind a piston ring 98. A similar port 100 passes a fluid to and from the region in front of the piston ring 98.

The components in FIG. 1 form a triangle between the center of the pivot pin 72 (point b), the elongated central axis of the tubing joint (point c), and the point of contact between the free jaw and tubing joint (point a). The self energizing grip is a result of the length bc always being smaller than the sum of the lengths ba plus ac. In the fully engaged orientation, it has been found that the tong assembly operates well when the cam angle, angle abc, is between approximately three (3) degrees and seven (7) degrees. At larger angles the free jaw and die tend to slip away from the tubing joint upon application of torque; the self energizing action is lessened. At smaller angles, loading throughout the backup tong is higher than otherwise desirable; high loads are placed on the pin 72, on the die teeth, and a larger spreading force is placed across the opening 36.

A single power train including the cylinder 92, piston rod 84, power gear 76 and free jaw 58 is shown fully in FIG. 1. A second similar train, exemplified at reference numeral 99, is positioned on the opposite side of the housing as a mirror image of the first described train. Similarly, lugs 40, 42 for attachment of the bushing 38 are also positioned on the opposite side of the housing.

Figure 9:
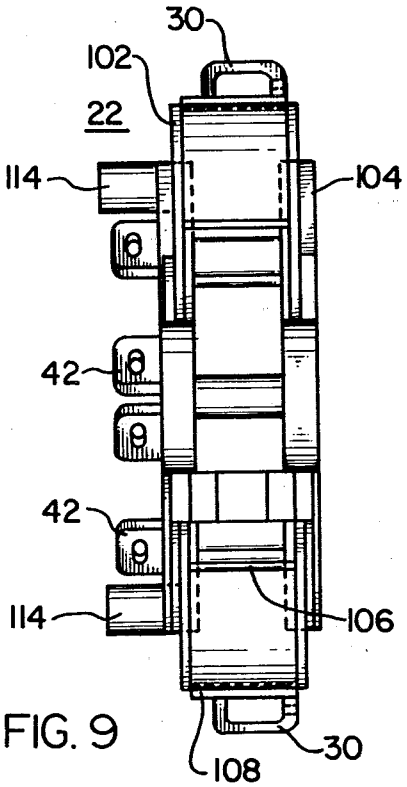
FIGS. 8, 9 and 10 are respectively a bottom, front and partial side view of a housing weldment of a backup tong in accordance with the invention.
Figure 10:
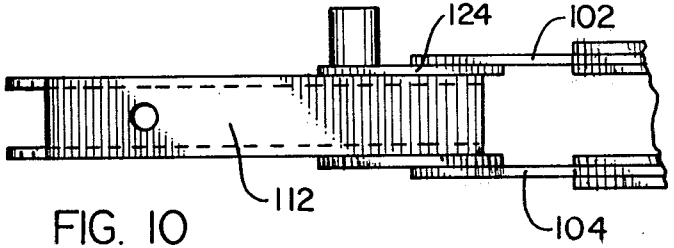

The housing 44 of the backup tong is, in conventional manner, comprised of a bottom plate assembly 102 and a top plate assembly 104, shown best in FIGS. 9 and 10. The free jaw 58, power gear, piston rod 84 and cylinder 92 are disposed between the plate assemblies 102, 104. The plate assemblies 102, 104 are separated by vertical supports 106 and side plates 108. The clips 30 are affixed to the side plates 108. The frontal region of the weldment and the backup tong 22 is open to allow for motion of the free jaw 58. Also shown in FIG. 9 are the housing lugs 42 which extend downwardly from the bottom plate assembly 102. The extension 112 at the rear of the backup tong 22 is shaped in cross section as a square channel, and fits loosely within the square opening 113 (FIG. 2). Sliding forward and rearward motion between the backup and power tongs can be accomplished by sliding along the square extension 112.

Figure 8:
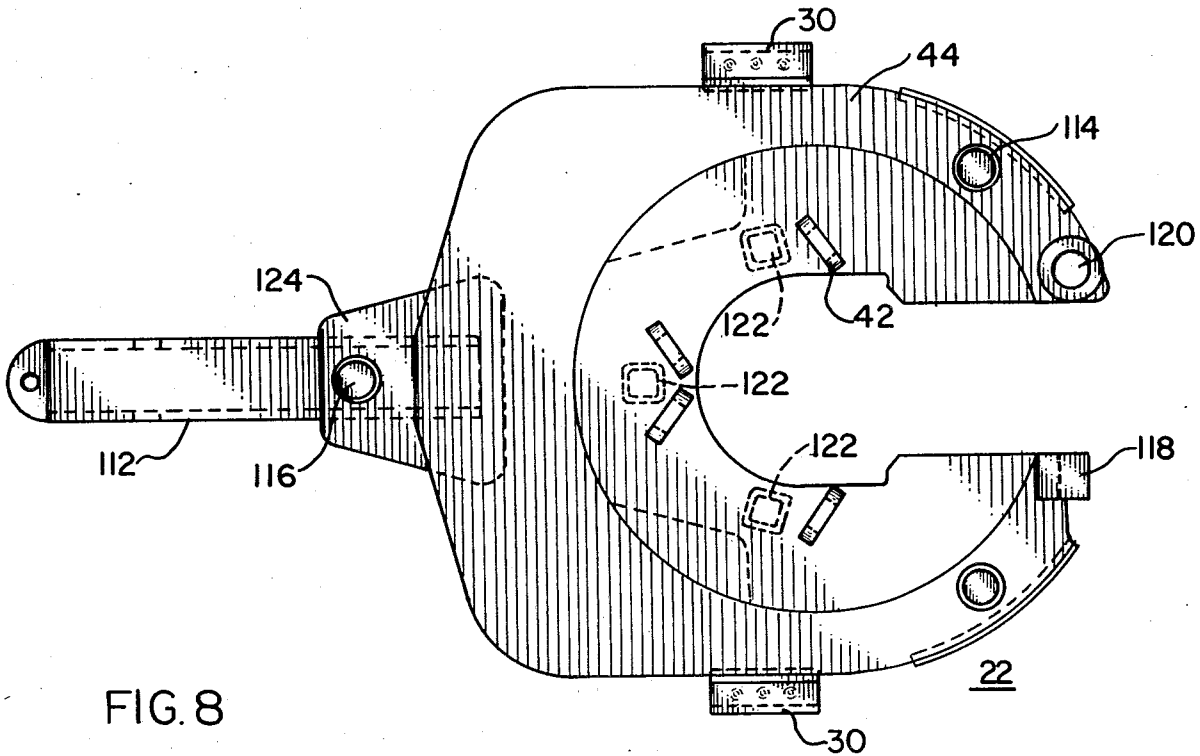

Additionally shown on FIG. 8 are front legs 114 and a rear leg 116. These legs 114, 116 are utilized when the tong assembly 20 is placed on a floor. The legs extend below the lugs 42 to protect the lugs from damage. At the forward end of the housing 44 weldment are shown a latch lug 118 and a hinge pin opening 120. The hinge pin opening 120 receives a hinge pin for pivotal attachment of a closure door 119 as well known. The door 119 is latched to the latch lug 118 in the closed position and adds rigidity to the backup tong to prevent the opening 36 from spreading upon the application of torque to the tool joint. Three square posts 122 add further rigidity to the housing 44. At the rearward portion of the housing 44 is a gusset 124 which adds structural support to the backup tong and particularly the region of connection of the extension 112.

Figure 11:
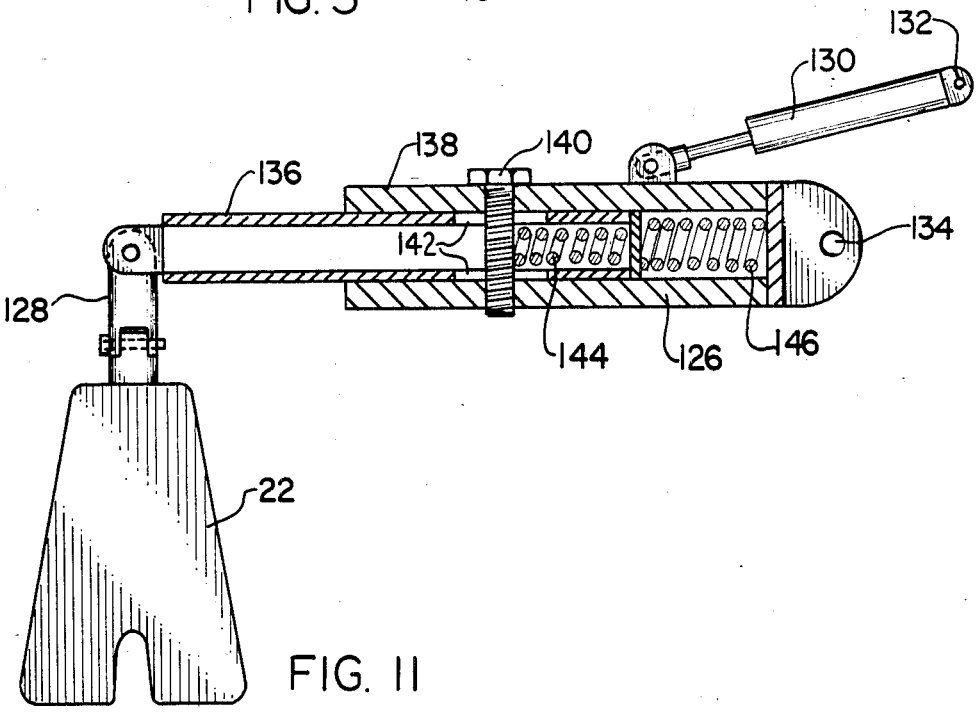
FIG. 11 is a simplified plan view, partially in section of a stiff arm and backup tong in accordance with the invention.

Referring now to FIG. 11, there is shown a stiff arm 126 interconnected to the backup tong 22 through a double hinge 128. Affixed to the stiff arm 126 is a fluid operated, preferably hydraulic, drive piston and cylinder 130. Both the drive cylinder 130 and the stiff arm 126 are pivotally affixed to the drilling rig on which the tong is used through respective pivot holes 132 and 134. The stiff arm 126 is comprised of an internal tube 136 telescopingly positioned within an external tube 138. A bar 140 extends through slots 142 in the internal tube 136. Springs 144 and 146 bias the internal 136 and external 138 tubes toward a preselected position.

Operation of the tong assembly 20 during joint makeup will now be described. The tong assembly is moved into a position whereby the elevation of the gripping structure of the power tong 24 allows the power tong to grip the upper tube. The die teeth of the free jaw of the backup tong are at an elevation to contact the lower tube. The tong assembly 20 is then moved to a position so that the opening 36 of the backup tong and a similar opening of the power tong is positioned about the tool joint 34. The stiff arm is connected to the backup tong and actuated such that the tong assembly is placed about the tool joint and the tool joint is positioned against the bushing rear surface 50. This movement involves extension of the drive piston and cylinder 130.

The backup tong is then actuated such that, as viewed in FIG. 1, the piston rod 84 is retracted into the cylinder 92, pivoting the power gear 76 clockwise and the free jaw 58 counterclockwise. The movement of the free jaw continues until the die 60 contacts the tool joint 34. The power tong 24 is then actuated so that the gripping dies or other structures engage the tool joint 34 so that the longitudinal axis of the power tong, identified by reference numeral 148 in FIG. 1, is aligned with the elongated central axis c of the tool joint 34. Stated in other terms, the power tong 24 is positioned so that the axis c of the tool joint 34 is coincident with the center point between the gripping dies of the power tong 24. The rotational movement of the tool joint which is created by the power tong, positions the tool joint against the side surface 52 of the replaceable bushing. In this position, the axis c of the tool joint is offset from the longitudinal axis 32 of the backup tong by a distance d. Stated in other terms, the longitudinal axis 32 of the backup tong is displaced laterally, at the central axis of the tool joint, a distance d with respect to the longitudinal axis of the power tong.

The power tong rotates the upper tube of the tool joint clockwise and, as additional torque is applied, the lower tube rotates a slight amount in a clockwise rotation. This slight clockwise rotation is limited by the self energizing setting of the die teeth 68 in the tool joint 34 wall. Thus, it will be noted that the cammed contour and positioning of the jaw 58 and die 60 is such that counterclockwise rotation of the free jaw, corresponding to clockwise rotation of the tubing, self energizes the contact since the distance from the pivot pin 70 to a point on the die teeth increases as the point moves clockwise along the die teeth. In this sense the jaw behaves with a camming action. The hardsurface finish of the bushing 38 allows the minimal rotation without galling of the tubing or bushing.

Continued application of torque to the upper tube in a clockwise rotation is resisted by a corresponding restraining torque in the lower tube in a counterclockwise direction f. The free jaw acts to restrain the torque in the lower tube by a corresponding reaction torque $f_1$ in a counterclockwise direction. These forces are transferred to the housing through the pin 72 and the replaceable bushing 38. The backup tong tends to rotate in a clockwise direction with respect to the power tong upon the continued application of torque to the upper tube to make up the tool joint. Rotation is restrained to approximately three (3) degrees with the power tong socket type square channel interconnection to the backup tong extension 112.

When the power tong has torqued the tool joint a preselected amount, the rotation is reversed to release the power tong grip on the upper member of the tool joint. To remove the backup tong from the lower member of the tool joint, the piston rod 84 is extended outwardly from the cylinder 92. This is accomplished by application of fluid pressure through port 96 to the rear of the piston ring 98, causing a force $f_3$ acting on the piston ring and a resulting force $f_4$ acting on the cylinder pin 94. The force $f_3$ is transmitted to the power gear 76 causing rotation in a counterclockwise direction identified as $f_2$ in FIG. 1. The power gear 76 transmits the force $f_2$ to the free jaw 58 through the intermeshing gear teeth. Motion of the free jaw is resisted by the penetration of the die teeth 68 in the tool joint. The lower member of the tool joint is fixed by forces external to the tool assembly such as those applied by a slip in a drilling table floor or merely the extreme weight of a long drilling string. As the interconnection between the backup and power tongs at the rear of the tong assembly is comprised of the square channel in a larger square opening, allowing limited relative rotation on the order of three degrees, the forces rotate the power tong in a counterclockwise direction. The stiff arm 138 will then extend or retract allowing counterclockwise rotation of the backup tong and power tong assembly for an amount sufficient to free the die penetration from the tool joint. The camming free jaw will then move to the disengaged retracted position within the backup tong housing, shown in phantom in FIG. 1, as the piston extends to its full forward position.

A breakout operation is generally the reverse of the makeup operation. The second gripping train 99 including a free jaw, power gear and piston and cylinder is utilized and the lower tubing of the tool joint is positioned and gripped in the opposite corner of the bushing against the rear surface 50 and the side surface 54. The forces generated upon actuation of the power tong to break out the joint through counterclockwise rotation of the upper tube result in a counterclockwise rotation of the backup tong relative to the power tong.

The disclosed tong assembly provides effective gripping of a tool joint for makeup and break out operations. A single gripping die is used during a given makeup or breakout sequence. Use does not require centering or longitudinal alignment of the power and backup tongs with respect to the tool joint and each other, providing greater operational flexibility than previously obtainable. Additionally, the backup tong can accommodate a relatively larger range of tool joint diameters with a given bushing as well as further expansion of that range through use of replaceable bushings. It will be apparent that many modifications and additions of the disclosed tong assembly are possible. It therefore is to be understood that the description and Figures are intended to be taken as exemplary, and not in a limiting sense.

We claim:

1. A tong assembly for makeup and break down of a threaded tubular tool joint having an upper section, a lower section and a central axis, comprising:

a power tong having a longitudinal axis and means for gripping and rotating said upper section of said tool joint;

a backup tong positioned below said power tong, said backup tong having a longitudinal axis, a bushing including a rear flat surface and two flat side surfaces, a first die having first teeth and first means for engaging said first die teeth with said lower section of said tool joint such that upon application of torque by said power tong to rotate said upper section in one direction said backup tong moves through a limited rotation relative to said power tong and said lower section is fixedly retained among said first die teeth, said rear surface and one of said side surfaces, and is positioned with said central axis of said tool joint at a first position spaced to one side of said longitudinal axis of said backup tong, said backup tong also having a second die having second teeth and second means for engaging said second die teeth with said lower section of said tool joint such that upon application of torque by said power tong to rotate said upper section in the opposite direction said backup tong moves through a limited rotation relative to said power tong and said lower section is fixedly retained among said second die teeth, said rear surface and the other one of said side surfaces, and is positioned with said central axis of said tool joint at a second position spaced to the other side of said longitudinal axis of said backup tong; and means for interconnecting said power tong and backup tong and for supporting one from the other, said interconnection means allowing said limited rotations of said backup tong, in a plane perpendicular to said central axis of said tool joint, relative to said power tong.

2. The tong assembly of claim 1 wherein said longitudinal axis of said power tong and said longitudinal axis of said backup tong are normally aligned one above the other and are unaligned upon said lower section of said tool joint being fixedly retained among said die, said rear surface and one of said side surfaces.

3. The tong assembly of claim 1 wherein said bushing is replaceable and said side surfaces are generally normal to said rear surface.

4. The tong assembly of claim 1 wherein said first die is contained in a first jaw configured as a cam such that upon application of a torque by said upper section to said lower section and initial contact of said lower section with said first die teeth, said rear surface and one of said side surfaces, said lower section initially slips against said rear and said one of said side surfaces and is then held fixed in position among said first jaw, rear surface and said one of said side surfaces.

5. The tong assembly of claim 4 wherein said first jaw is positioned and configured with a cam angle between approximately 3 and 7 degrees.

6. The tong assembly of claim 1 wherein said interconnection means comprise a pair of flexible arms extending from a rearward portion of said power tong to a forward portion of said backup tong.

7. A tong assembly for gripping and rotatably engaging a threaded tubular joint having an upper section, a lower section, and an elongated central axis, comprising:

a power tong having a main body, a forward opening in said body for receiving said upper section and means for gripping and rotating said upper section within said opening;

a backup tong having a main housing supporting a first movable free jaw having first die teeth, a second movable free jaw having second die teeth, and a bushing including an aperture for receiving said lower section bounded at least in part by a rear flat surface and two flat side surfaces, first means for moving said first jaw and first die teeth into engagement with said lower section such that upon application of torque by said power tong to rotate said upper section in one direction said backup tong moves through a limited rotation relative to said power tong and said lower section is positioned in a first position touching said rear surface and one of said side surfaces, and second means for moving said second jaw and second die teeth into engagement with said lower section such that upon application of torque by said power tong to rotate said upper section in the opposite direction said backup tong moves through a limited rotation relative to said power tong and said lower section is positioned in a second position touching said rear surface and the other end of said side surfaces, said first position being spaced from said second position; and means for interconnecting said power tong and backup tong such that said backup tong is movingly supportable from said power tong, said interconnection means allowing said limited rotation of said backup tong in a plane substantially normal to said central axis of said tubular joint.

8. The tong assembly of claim 7 wherein said bushing is removably mounted to said backup tong and said bushing aperture is generally channel shaped, each of said side surfaces being generally normal to said rear surface.

9. The tong assembly of claim 8 wherein said bushing includes a window through which said free jaw is movable into and out of said aperture.

10. The tong assembly of claim 9 wherein said interconnection means comprise a pair of flexible arms affixed at one extent to the rearward portion of said power tong and at the other extent to the forward portion of said backup tong.

11. The tong assembly of claim 7 wherein said power tong includes a power tong longitudinal axis and said backup tong includes a backup tong longitudinal axis, wherein upon said tubular joint being centered in said bushing said longitudinal axes and said central axis are coincident, and wherein upon said tubular joint being positioned to contact said first free jaw, rear surface and one of said side surfaces, said elongated central axis of said tubular joint is positioned coincident with said power tong longitudinal axis and spaced laterally from said backup tong longitudinal axis.

12. The tong assembly of claim 7 wherein said first free jaw is rotatably affixed to said backup tong through a pinned connection point such that, upon contact of said first free jaw and said tubular joint at a primary contact point, a cam angle is formed between a line extending from said pinned connection point through said central axis of said tubular joint and another line extending from said said pinned connection point through said said primary contact point, and whereby said cam angle is between approximately 3 degrees and 7 degrees.

13. The tong assembly of claim 7 further comprising means for powering movement of said backup tong with respect to said tubular joint including a stiff arm hingedly affixed at one extremity to said backup tong and pivotally affixed at the other extremity, and a power cylinder for rotating said stiff arm about said other extremity, said stiff arm being configured to allow expansion and contraction of the length thereof.

* * * * *